US009163631B2

(12) United States Patent
Flenche

(10) Patent No.: US 9,163,631 B2
(45) Date of Patent: Oct. 20, 2015

(54) FLUID COMPRESSOR OR PUMP APPARATUS

(75) Inventor: George Flenche, Elizabeth Downs (AU)

(73) Assignee: Exodus R&D International Pte Ltd, Singapore (SG)

( * ) Notice: Subject to any disclaimer, the term of this patent is extended or adjusted under 35 U.S.C. 154(b) by 644 days.

(21) Appl. No.: 13/509,572

(22) PCT Filed: Nov. 12, 2010

(86) PCT No.: PCT/AU2010/001515

§ 371 (c)(1),
(2), (4) Date: Sep. 25, 2012

(87) PCT Pub. No.: WO2011/057345

PCT Pub. Date: May 19, 2011

(65) Prior Publication Data

US 2013/0017109 A1 Jan. 17, 2013

(30) Foreign Application Priority Data

Nov. 12, 2009 (AU) ..... 2009905515

(51) Int. Cl.

| | |
|---|---|
| ***F04C 9/00*** | (2006.01) |
| ***F04C 14/14*** | (2006.01) |
| ***F04C 15/06*** | (2006.01) |
| *F01C 17/02* | (2006.01) |

(52) U.S. Cl.

CPC ..... *F04C 9/002* (2013.01); *F04C 14/14* (2013.01); *F04C 15/06* (2013.01); *F01C 17/02* (2013.01); *F04C 2250/10* (2013.01)

(58) Field of Classification Search

CPC ..... F04C 9/002

USPC ..... 417/481, 482, 410.3

See application file for complete search history.

(56) References Cited

U.S. PATENT DOCUMENTS

| | | | | |
|---|---|---|---|---|
| 1,010,583 | A | 12/1911 | Carmichael et al. | |
| 1,516,584 | A * | 11/1924 | Wilson | 417/482 |
| 2,359,619 | A | 10/1944 | Bachrach | |
| 2,359,819 | A * | 10/1944 | Bachrach | 417/481 |
| 2,413,636 | A * | 12/1946 | Long | 92/122 |
| 2,433,461 | A * | 12/1947 | Kuttner | 92/122 |
| 4,027,475 | A * | 6/1977 | Folsom | 60/369 |

(Continued)

FOREIGN PATENT DOCUMENTS

| | | |
|---|---|---|
| BE | 347490 | 1/1928 |
| DE | 29717787 | 1/1998 |
| DE | 102007047682 | 4/2009 |
| KR | 100762892 | 9/2007 |

(Continued)

OTHER PUBLICATIONS

Patent Cooperation Treaty; International Search Report of PCT/AU2010/001515; Dec. 22, 2010; Ian Hill; 3 pages.

*Primary Examiner* — Nathan J Newhouse
*Assistant Examiner* — Christopher Bobish
(74) *Attorney, Agent, or Firm* — Weiner & Burt, P.C.; Irving M. Weiner; Pamela S. Bart

(57) ABSTRACT

The present invention relates to an apparatus which may be in the form of a pump or compressor and which can function to compress or accelerate a fluid such as air, gas, gaseous mixtures and/or liquid. In particular, the invention provides a mechanism in which fluid can be admitted and then discharged continuously from each of the radial compartments that make up the compressor chamber.

28 Claims, 7 Drawing Sheets

(56) References Cited

U.S. PATENT DOCUMENTS

| | | | | | |
|---|---|---|---|---|---|
| 4,252,509 | A | * | 2/1981 | Hagerty | 417/482 |
| 5,203,684 | A | * | 4/1993 | Henriksen | 417/484 |
| 5,979,163 | A | * | 11/1999 | Hanners et al. | 60/571 |

FOREIGN PATENT DOCUMENTS

| | | | |
|---|---|---|---|
| KR | 100762892 | B1 | 10/2007 |
| WO | 89/05918 | A | 6/1989 |
| WO | WO 02/101201 | | 12/2002 |

* cited by examiner

FLUID COMPRESSOR OR PUMP APPARATUS

CROSS-REFERENCE TO RELATED APPLICATIONS

This application is a U.S. National Phase application submitted under 35 U.S.C. §371 of Patent Cooperation Treaty application serial no. PCT/AU2010/001515, filed Nov. 12, 2010, and entitled FLUID COMPRESSOR OR PUMP APPARATUS, which application claims priority to Australian patent application serial no. 2009905515, filed Nov. 12, 2009, and entitled FLUID COMPRESSOR OR PUMP APPARATUS.

Patent Cooperation Treaty application serial no. PCT/AU2010/001515, published as WO 2011/057345, and Australian patent application serial no. 2009905515, are incorporated herein by reference.

TECHNICAL FIELD

This invention is directed to an apparatus which may be in the form of a pump or compressor and which can function to compress or accelerate a fluid such as air, gas, gaseous mixtures and/or liquid.

BACKGROUND

For the most part pumps and compressors utilize a mechanical action so as to force an admitted fluid drawn into the system to increase its velocity which is then converted into pressure or alternatively a pumping action.

Typically compressors and pumps based around a piston connected to a crank has the piston reciprocating in the cylinder and the reciprocating action results in pumping fluid which passes into the cylinder. The pump is typically electrically powered, for example by a motor or even in some cases internal combustion motors and so forth.

As the person skilled in the art is well aware one disadvantage of this type of pump is that pumping occurs only when the piston is in the compressive stroke. When a piston is in the drawdown stroke, no pumping occurs as the drawdown stroke is required to suck additional fluid into the cylinder or housing.

Therefore, half the action of the piston does not contribute to the pumping action.

There are a variety of other problems with such arrangements not the least wherein the piston has a short stroke and this results in increased wear and tear on the pump. As is to be expected these types of piston pumps generally suffer from excessive noise levels making them unsuitable for many applications.

While there are alternatives to piston based pumps and compressors for the most part these center around rotary volumetric designs, typically with radial vanes driven by an electric motor. These kinds of pumps and compressors draw fluid from the atmosphere through an intake opening directed to a pressure tank through a minimum pressure valve which opens only when a predetermined minimum pressure has been reached within the compressor unit or pump apparatus.

One of the main disadvantages of rotary volumetric type based compressors and pump apparatus is the intermittent operation type control system which means that the operations of the electric motor is suspended when the pressure reaches the upper limit value, and while this may reduce electric power loss and improved consumption of the arrangement, nonetheless since the motor is started over again and again from the stationary state when the pressure falls thereafter, it is impossible to promptly supply compressed air or a pumping action when required.

It is therefore an object of this invention to provide a fluid compressor and/or pump apparatus which can compress or pump a fluid, such as air, gas, gaseous mixtures and liquids which may overcome at least some of the above mentioned disadvantages.

From hereonafter throughout this specification the use of the word compressing is to be considered synonymous with the ability to also pump therefore while the apparatus described throughout this invention may relate to the compressing of a fluid, it is to be appreciated by the person skilled in the art that the apparatus defined is equally capable of pumping fluid.

SUMMARY

Accordingly in one form of the invention there is provided an apparatus for pumping or compressing a fluid, the apparatus characterized by:

a compressor chamber including a means of compressing admitted fluid, wherein the compressor means comprises a plurality of radial compartments wherein intermittent baffles define the boundary for each radial compartment, enclosed therein said radial compartment is a solid segment adapted to move relative to the baffles that define the radial compartments;

said radial compartments characterized by having two inlet apertures to admit fluid and two outlet holes to discharge pressurized fluid, a fluid control arrangement to control admitted and/or discharged fluid to and from the radial compartments making up the compressor chamber;

a valve means including a rotatable circular plate with a series of symmetrically placed holes there along such that the rotation of this circular plate or ring with the intermittent holes allows the opening or part thereof of one inlet aperture to the radial compartment of the compressor portion and the closing or part thereof of the other inlet aperture;

said valve means further including one way control valves on each of the outlet apertures of the radial compartments of the compressor portion;

a means of moving the baffles in a back and forth oscillation to create relative movement between the baffles against the triangular segments to create a bellowing effect to admit fluid into the respective radial compartments and a simultaneous discharge thereout through one of the outlet apertures.

The apparatus may further include a main housing block providing a drive portion supporting a rotatably driveable shaft in operable communication with a compression portion defining said compression chamber.

In preference said drive portion is in the form of an electric motor.

The means of oscillating the baffles is in the form of a cam mechanism adapted to translate the rotatable motion of the drivable shaft into a back and forth oscillation movement of the baffles.

In a further form of the invention there is proposed an apparatus for pumping or compressing a fluid, the apparatus including:

a main housing block providing a drive portion supporting a rotatably drivable shaft in operable communication with a compression portion of said main housing block;

the compression portion defining a compressor chamber in its interior;

the compressor chamber including a compressor means of compressing admitted fluid, wherein the compressor means comprises a plurality of radial compartments wherein intermittent baffles define the boundary for each radial compartment, enclosed therein said radial compartment is a triangular segment wherein the triangular segments are adapted to move relative to the baffles that define the radial compartments;

said radial compartments characterized by having two inlet apertures to admit fluid and two outlet holes to discharge pressurized fluid, a fluid control arrangement to control admitted and/or discharged fluid to and from the radial compartments making up the compressor chamber;

fluid control arrangement including a rotatable circular plate with a series of symmetrically placed holes there along such that the rotation of this circular plate or ring with the intermittent holes allows the opening or part thereof of one inlet aperture to the radial compartment of the compressor portion and the closing or part thereof of the other inlet aperture, fluid flow control arrangement further including one way control valves on each of the outlet apertures of the radial compartments of the compressor portion;

a cam mechanism adapted to translate the rotatable motion of the drivable shaft into a back and forth oscillation movement to create relative movement between the baffles against the triangular segments to create a bellowing effect to admit fluid into the respective radial compartments and a simultaneous discharge thereout through one of the outlet apertures.

Advantageously, this arrangement provides for a mechanism in which fluid can be admitted and then discharged continuously from each of the radial compartments that make up the compressor chamber.

Through the use of the circular ring or plate and symmetrically placed holes thereon, as the baffles and triangular segments are rotated back and forth relative to the other to create a bellowing effect that can provide both a suction or vacuuming effect but at the same time a pumping effect so that in combination with the cam mechanism the holes on the rotatable circular ring can align themselves with one of the inlet apertures or parts thereof of both apertures for admitting fluid into the respective radial compartments of the compressor chamber.

While one edge of the triangular segments moves up against the baffles is compressing air, the other side of the triangular segment inside the radial compartment of the compressor chamber is in fact admitting fluid therein to this particular radial compartment by virtue of the fact that the intermittent holes of the circular ring or plate have aligned over the corresponding inlet hole thereby allowing the admission of the fluid therein to the radial compartment.

Nonetheless on the other side of the triangular section which has had its inlet hole covered or partly covered by this oscillating back and forth circular ring or plate means that in this portion or side of the radial compartment no fluid our reduced amounts are being admitted but as the triangular segment is rotating its way towards the baffle wall the fluid is being compressed and therefore has no alternative but to exit this side or portion of the radial compartment through the one way valve.

As can be seen each radial compartment by virtue of the two portions or sides thereof which are characterized in having both inlet apertures and outlet holes which are controlled by one way valves for every radial compartment that makes up the compressor chamber there is a simultaneous capability of providing not only a suction or vacuuming effect to admit fluid but also the ability to in fact pressurize fluid into a confined space and then discharge it out of the compressor chamber through the use of the one way valve control.

In preference the baffles will be rotatably supported and the triangular segments remain fixed in place inside the compressor chamber.

In preference the baffles that provide for these radial compartments include therein triangular segments of slightly less dimensions.

Hence when the baffles oscillate and rotate back and forth by virtue of the cam mechanism means that on one side of the radial compartment the triangular segments move away from one baffle towards the other baffle on the other side of the radial compartment, and this means that on the side of the triangular segment to which spacing within the baffle dividers is increasing it can absorb or suck fluid into the compressor chamber and accordingly then on the other side of the triangular segment where the combined space is significantly less as this side of the triangular segment is pushed up against the side of the baffle, compressed fluid can be created and by virtue of the one way valves which can be set at their required pressure release levels means that once the fluid has been compressed to its required level it can then be discharged accordingly.

Therefore an important operation of the flow control of the fluid centers around the use of the circular ring or plate which has the intermittent holes thereon as it can open or cut off fluid exchange or reduce it in part there through each of the inlet apertures of the respective radial compartments that are making up the compressor chamber.

Hence for each cycle, the rotating circular plate or ring will be providing or allowing fluid to be admitted into one the inlet apertures wherein the other will be blocked. Nonetheless on the side of the radial compartment where the inlet aperture has been blocked by the oscillating rotating circular ring or plate, by virtue of the fact that it is undergoing a compression action by being pushed up against the side of the baffle, this side of the radial compartment will allow the formation of compressed fluid which can then be discharged thereout through the one way valve control mechanism into a compressor storage tank or for immediate use.

In preference the baffles are supported on a rotatable shaft wherein the shaft by virtue of its structural arrangement with the cam mechanism will oscillate or swing back and forth over a defined degree of angle.

In preference there are six individual radial compartments in the compressor chamber.

In preference each triangular segment includes an orifice or elongated recess at least partially extending into the depth of said triangular segment, wherein each of the orifices or recesses is located on an opposing side of the triangular segment so that inside the radial compartment effectively the recesses on opposing sides of the triangular segment divides partition means for exclusively engaging with just the one single inlet aperture.

In preference the inlet apertures are preferably a series of holes placed on a covering plate defining the radial diameter of the radial compartments.

In preference the orifices or recesses of the triangular segments extending to the depth of the triangular segment on opposing edges of the triangular segment and are substantially conical or cone type in configuration with part of the edge, length or shoulder of the conical configuration opened up so as to again provide a design wherein fluid passage flow is always moving from a space of varying bounded dimension.

In preference the degree of rotation of the back and forth oscillating movement between the baffle and the triangular segment would be twenty degrees.

BRIEF DESCRIPTION OF THE DRAWINGS

The above and other objects, features, and advantages of the present invention will be apparent from the following detailed description of a preferred embodiment in conjunction with the accompanying drawings. In the drawings.

DETAILED DESCRIPTION

The following detailed description of the invention refers to the accompanying drawings.

Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

Figure 1:
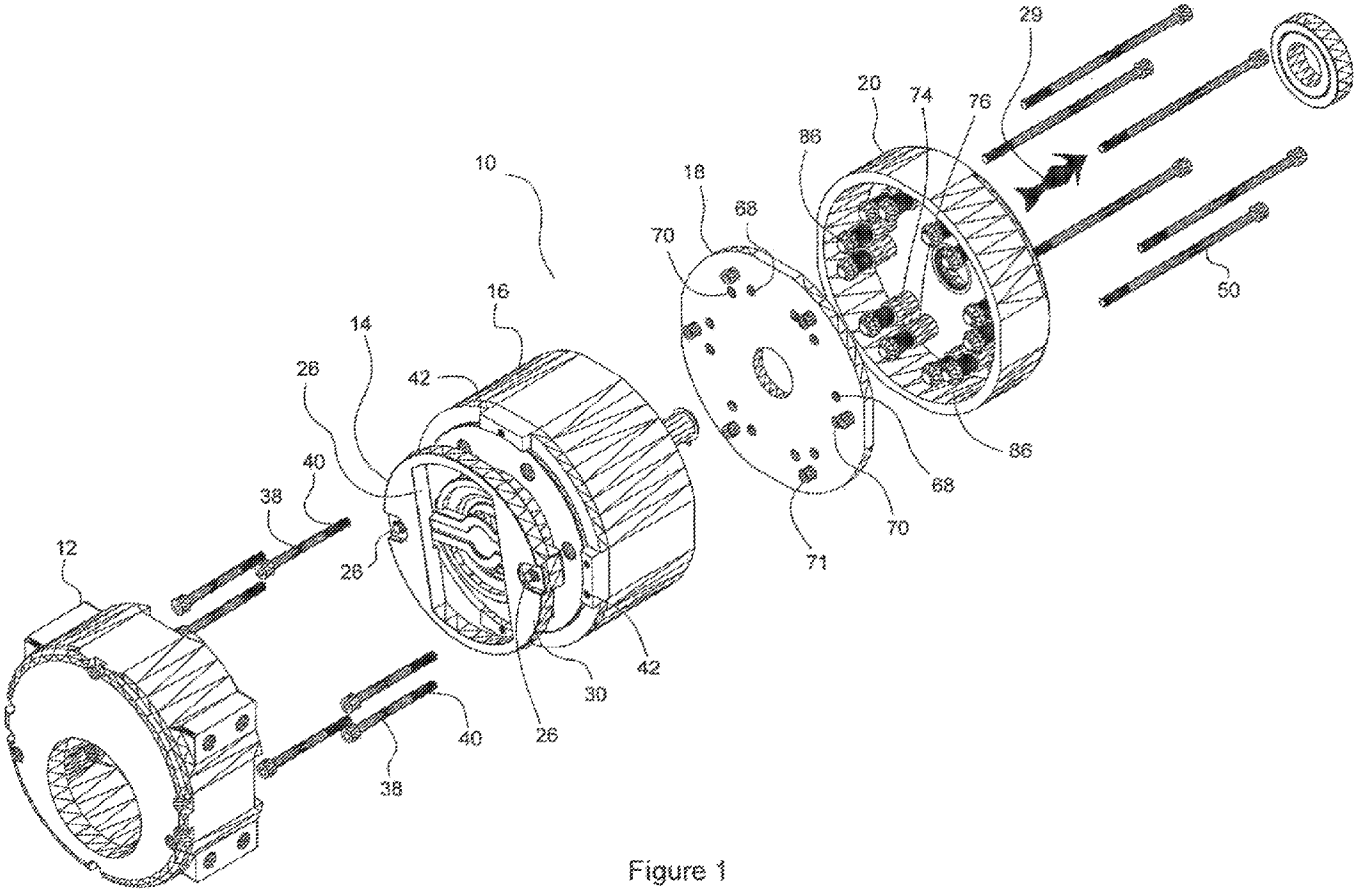
FIG. 1 is a perspective exploded view showing the compression or pumping portion of the fluid compressor or pumping apparatus.

The main compression portion of the fluid compressor or pump apparatus of an embodiment of this invention is shown generally as 10 in FIG. 1 with an exploded representation.

Included is a front cover 12 a main compression body or cover 16 and rear cover 20.

Rods or bolts 50 which can be extended up through guide holes 72 and column 71 up through the triangular segment apertures 66 and then onto the hole plate 48 so as to bring these components together.

Rods or bolts 38 with corresponding threads 40 are adapted to be fixed into threaded holes 42 so as to place the front cover 12 onto the main compressor portion body 16.

The cam ring 14 includes pins 26 and along with shoulder 24 can control the degree of oscillation of the circular ring 28 which includes a series of symmetrically positioned holes 30.

A cam ring 14 has an extending shoulder (not shown) extending in the direction of arrows 27 which can rest inside the ingress 34 of the circular ring or plate 28.

As a person skilled in the art will appreciate the cam ring is able to translate the continuous rotational movement of a shaft from a driving mechanism such as the motor and so forth into oscillated movements of the plate 28 and is soon to be discussed the rotatably engageable shaft 52 supporting the baffles 56 inside the compressor chamber.

Figure 2:
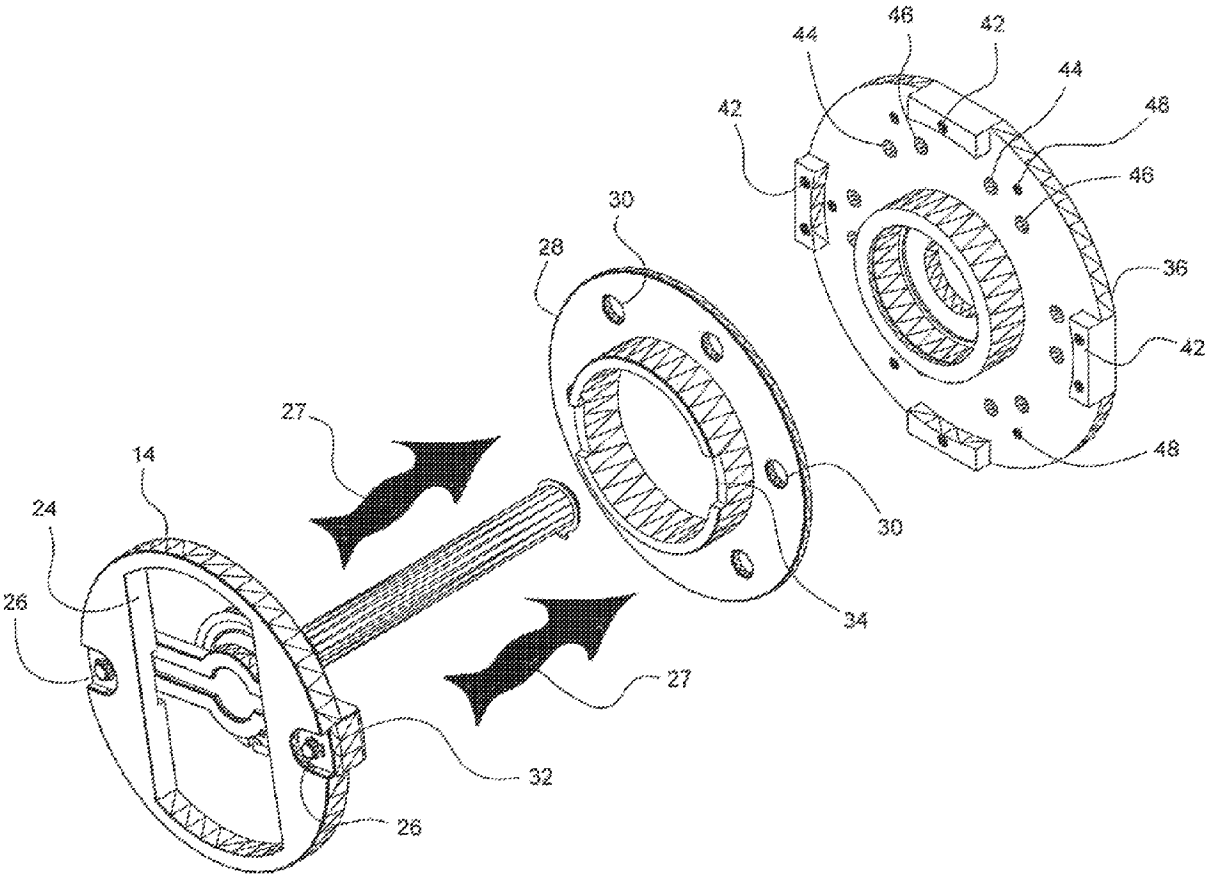
FIG. 2 is an exploded part portion of FIG. 1 showing the cam ring and the control means being able to define the flow of fluid into the compressor chamber by virtue of the circular ring or plate with the illustrated hole plate.

As can be interpreted from the illustrations relating to FIG. 1 and FIG. 2 fluid is able to be admitted into the main compression portion 16 of the fluid compressor or pump apparatus, shown generally as 27 in FIG. 2 through the holes 30 of the circular ring 28.

When the apparatus is constructed rotation of the plate 28 will be such that the hole 30 will rest over just one of the inlet apertures 44, 46 of each of the respective radial compartments that make up the compressor chamber and are defined or provided for by the baffles 56 that radially extend out from the shaft 52 which is adapted to oscillate back and forth in relative movement against the positioned triangular segment 60.

At the other end of the triangular segments that include ingresses or open recesses 62 and 64 is what one could be described as a rear plate that includes corresponding outlet holes from each of the radial compartments defined inside the compressor chamber by virtue of the radially extending baffles 56 which is supported on shaft 52.

Therefore as the person skilled in the art can appreciate each radially compartment inside the compressor chamber of the fluid compressor or pump apparatus, which in the exemplary embodiment is six compartments, effectively has two inlet apertures and two outlet holes.

Nonetheless the admission of fluid into the respective radial compartments is controlled by the ring 28 which is oscillating back and forth by virtue of the cam mechanism provided for by cam ring 14.

Hence the hole 30 being of a larger dimension than each of the inlet apertures 44 and 46 is continually oscillating back and forth and thereby allowing really continuously the admission of fluid for each of the radial compartments, albeit it to one side or a part thereof.

When the hole 30 of the circular ring operate 28 is completely over one of the inlet apertures at that moment in time one side will be sucking or admitting fluid there into one side of the radial compartment wherein the other side will be effectively discharging compressed fluid thereout.

However as is to be appreciated as the hole 30 of the circular ring is oscillating back and forth there will be moments in time when in fact both inlet apertures 44 and 46 are to varying degrees admitting fluid therein.

Figure 4:
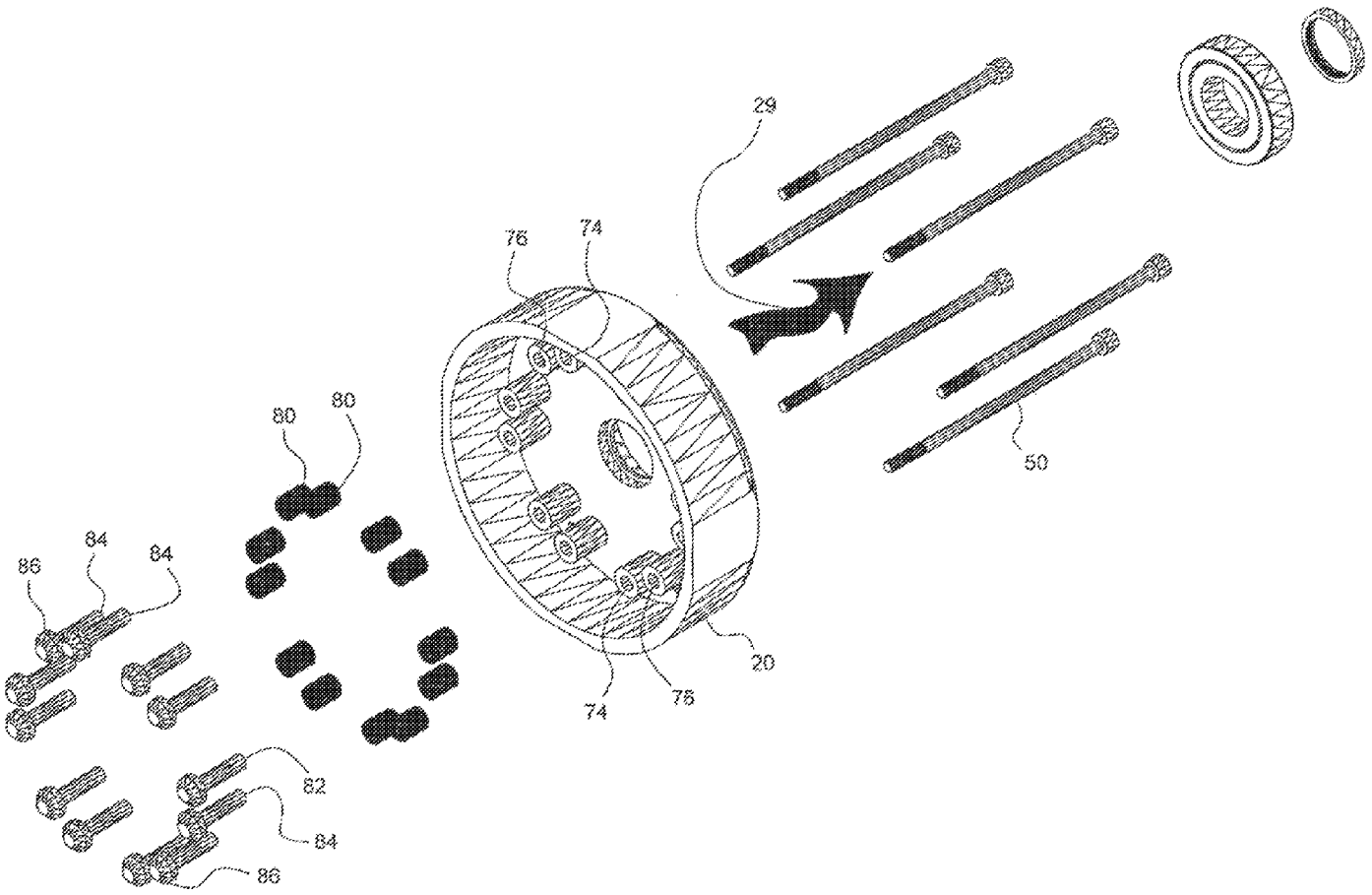
FIGS. 4 and 5 are exploded views showing the rear cover but also includes the one-way valves which control the release of the compressed fluid from the compressor chamber of the unit.

Nonetheless by virtue of the outlet holes 68 and 70 and the use of one way control valves best seen in FIG. 4 that include springs which house the valves 84 with their caps 86 means that discharge of the fluid can only take place once it matches the resilience or pressure provided for by the one way control valve which in this instance utilizes springs 80.

As discussed above as the baffles 56 rotate towards the triangular segments a bellowing effect is created.

Fluid will be sucked in on one side whereas fluid on the side that compression is taking place will reach a level high enough to push down the one way valves for discharge thereout.

Arrow 29 shows the general discharge of compressed fluid thereout.

Nonetheless as the person skilled in the art can appreciate the series of one way valves shown generally as 84 with their matching cap 86 for the position about the respective holes 68, 70 of the rear plate 18 could all be joined together through various conduits or slots or just the one single discharge location.

Figure 3:
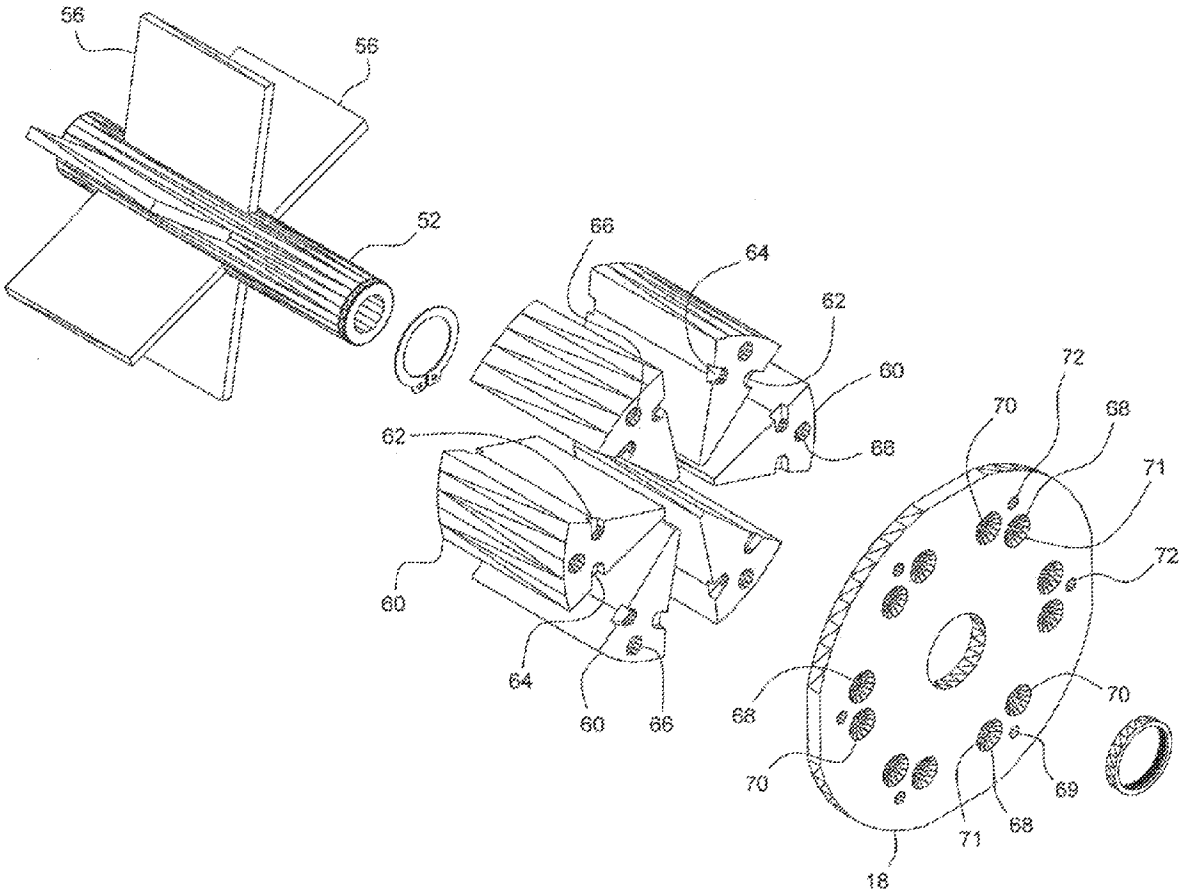
FIG. 3 is also a part exploded portion of FIG. 1 showing the compression components and the plate that include the outlet holes for each of the respective radial compartments defined by the baffles and the triangular segments.

As best seen in FIG. 3 the rear plate has the holes nicely tapered 71 so that the caps 86 of the one way spring loaded valves can comfortably rest therein the rear plate 18 and therefore there is no unnecessarily undirected release of fluid when the valves are in their closed position.

Figure 5:
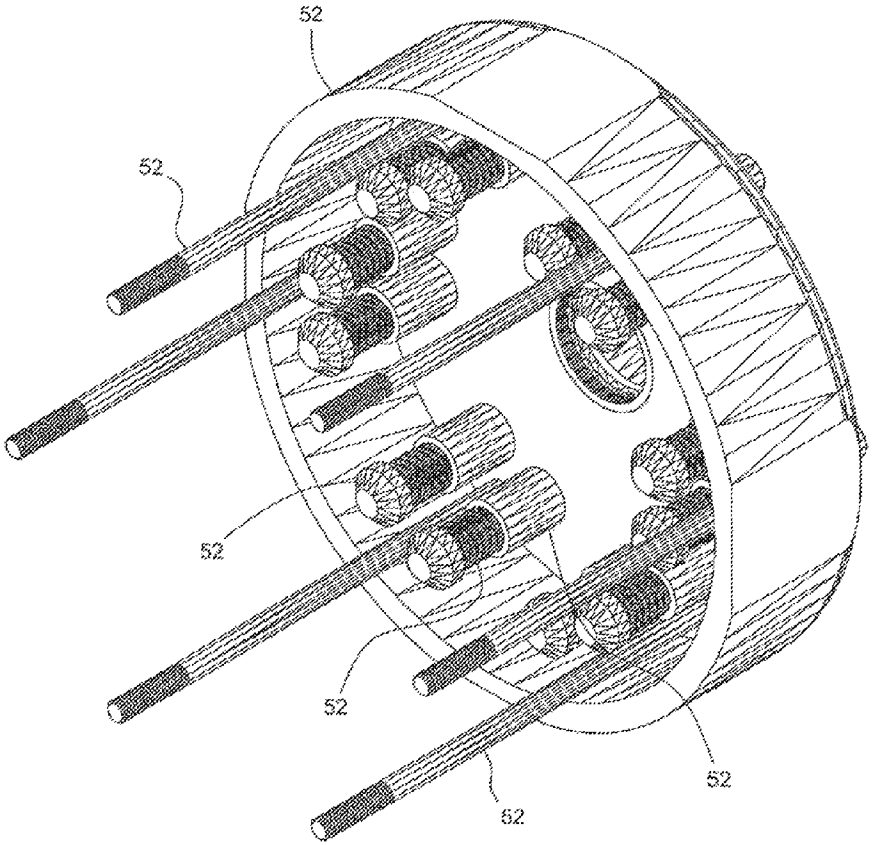

As best seen in FIG. 5 the one-way valves can rest comfortably inside support conduits 76.

As the person skilled in the art will appreciate the actual arrangement of the one-way valve is not critical or essential to the invention in any way.

Figure 6:
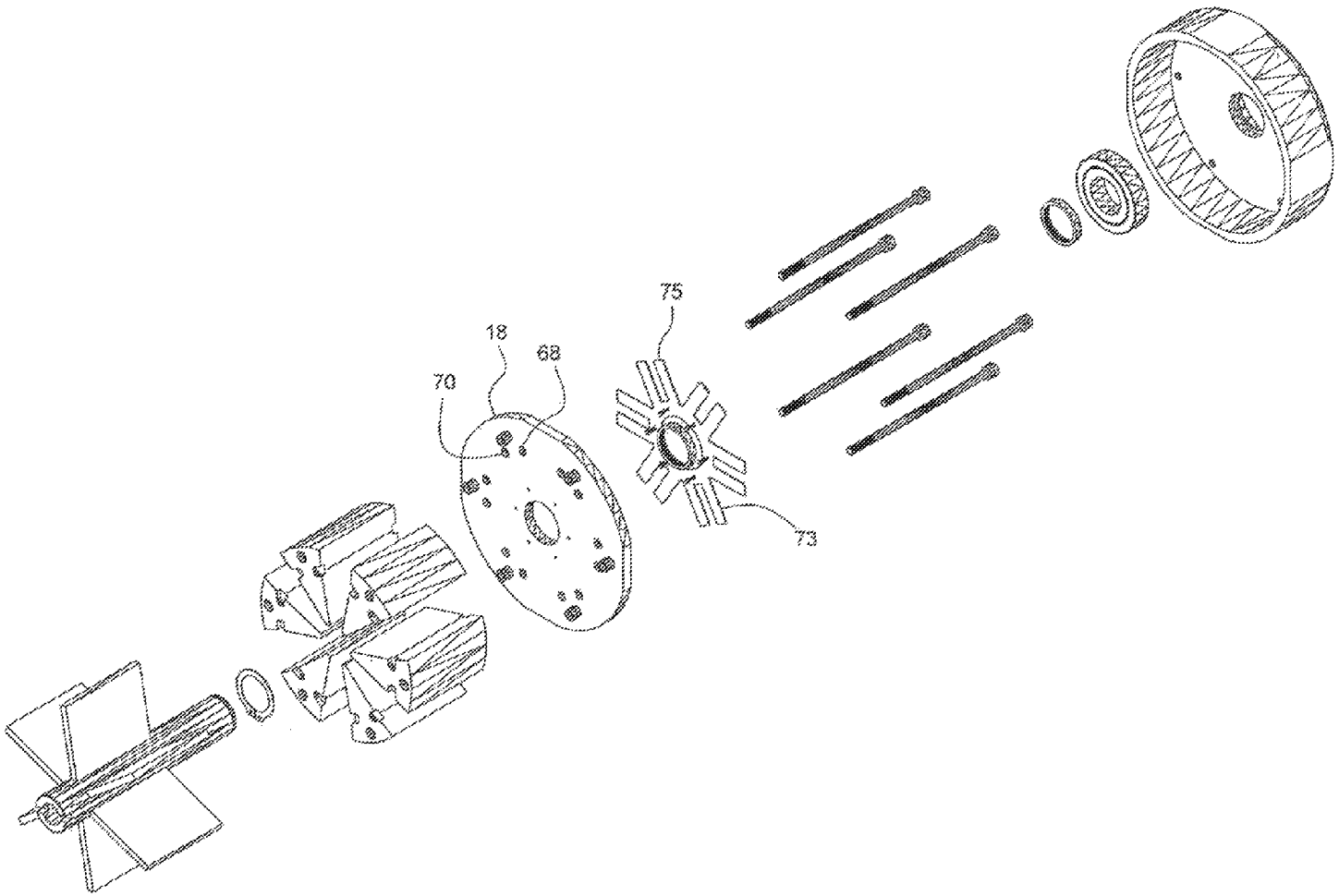
FIG. 6 shows a further embodiment of the invention wherein rather than using wounded springs as one way valves a reed valve arrangement is utilized.

One-way valve mechanisms can also be provided by a variety of other alternative embodiments including the one shown in FIG. 6 whereby a reed valve mechanism shown generally as 73 is provided for where the respective leafs 75 of the reed plate covers each of the holes 68, 70 of the rear plate 18.

Figure 7:
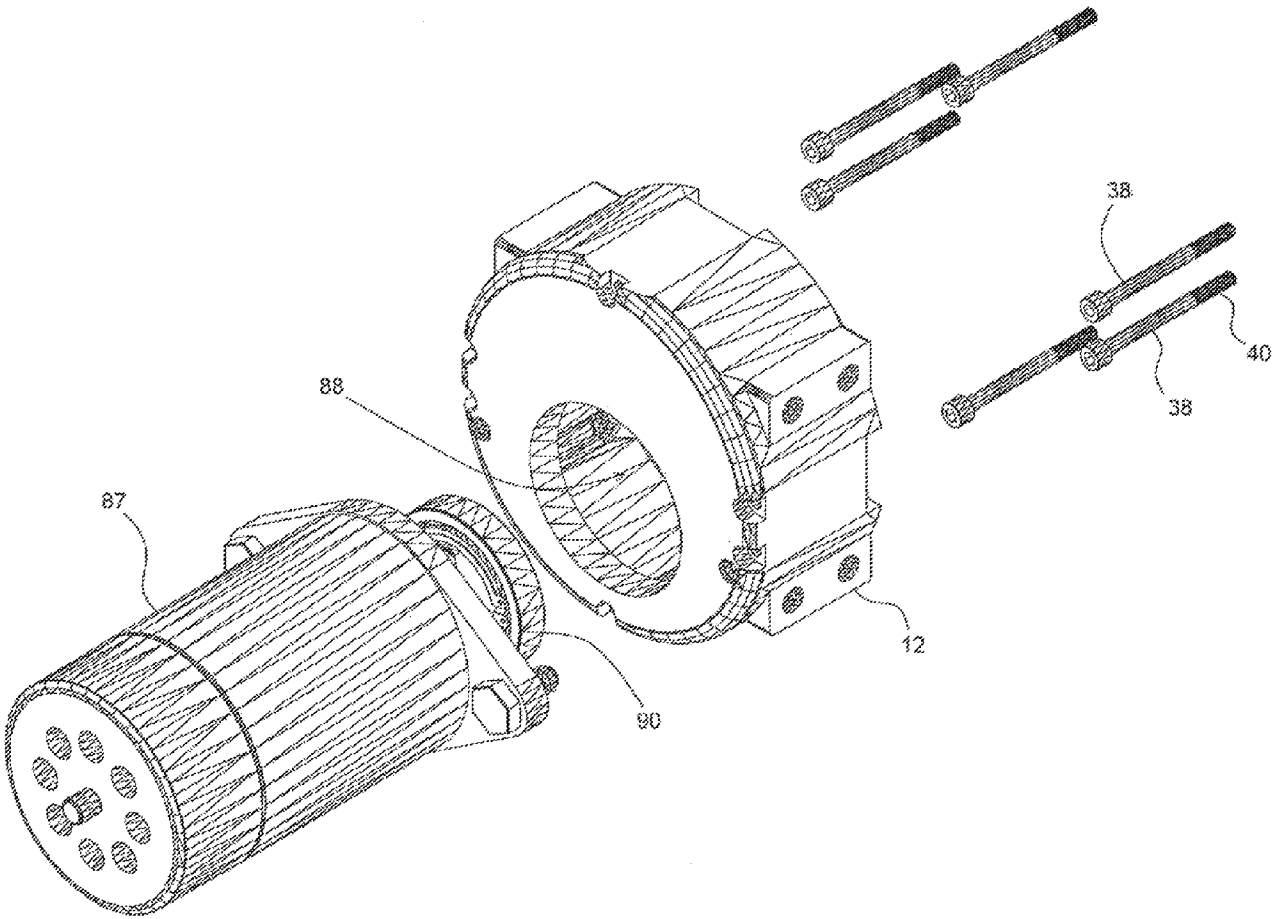
FIG. 7 is a perspective view showing the drivable portion of the fluid compressor or pump apparatus and its engagement with the main compression portion.

In FIG. 7 a drivable portion is simply an electric motor 87 wherein aperture 88 of the main front cover allows the insertion thereof guide 90 to interact with the cam mechanism in order to translate the continuous circular rotation of the motor into an oscillation back and forth thereof of both the valve plate or circular ring 28 as well as the baffles 56 upon shaft 52.

What remains essential to this invention is the unique use of the compressor chamber which is made up of the rotatable baffles which are able to oscillate or swing back and forth by virtue of the cam mechanism to a defined angle.

This relative movement of the baffles to the triangular segments, which in the preferred embodiment, has the triangular segments fixed and the baffles oscillating allows for the creation of radial compartments in the compressor chamber whereby the movement of the baffles up against or away from a respective triangular segment creates a bellowing effect which provides a mechanism to which fluid can be admitted into the compressor chamber but also a means in which fluid can be compressed and providing the compressed level of the fluid has been reached it will then be able to activate the one way valves to release the compressed fluid.

Advantageously by having the circular ring also as a valve mechanism by the use of its intermittent holes one is able to control the admission of fluid into each of the respective radial compartments.

Again this is achieved by the unique ability of this circular ring or plate to be able to oscillate over and across each of the inlet apertures to allow the continued admission or the cut off of fluid into the respective sides or portions of the radial compartments about the edges of the triangular segments.

Effectively this bellowing is creating a means by which a continuous admission of fluid can enter the compressor chamber and also a continuance of discharge of compressed fluid from the same compressor chamber all within the same cycle.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e., the features specified may be associated with further features in various embodiments of the invention.

The invention claimed is:

1. An apparatus for pumping or compressing a fluid, the apparatus comprising:

a compressor chamber including a means of compressing admitted fluid, wherein the compressing means comprises a plurality of radial compartments wherein intermittent baffles define a boundary for each radial compartment, enclosed therein said radial compartment is a solid triangular segment adapted to move relative to the baffles that define the radial compartments, said radial compartments having two inlet apertures to admit fluid and two outlet holes to discharge pressurized fluid;

a fluid control arrangement adapted to control admitted and/or discharged fluid to and from the radial compartments making up the compressor chamber;

a valve including a rotatable circular plate or ring with a series of symmetrically placed holes there along such that the rotation of this circular plate or ring with the intermittent holes allows the opening or partial opening of one inlet aperture to one of the radial compartments of the compressor portion and the closing or partial closing of the other inlet aperture of the one compartment; said valve further including one way control valves on each of the outlet apertures of the radial compartments of the compressor portion; and means for oscillating the baffles in a back and forth oscillation movement to create relative movement between the baffles against the triangular segments to create a bellowing effect to admit fluid into the respective radial compartments and a simultaneous discharge thereout through one of the outlet apertures.

2. The apparatus of claim 1, further comprising a main housing block providing a drive portion supporting a rotatably driveable shaft in operable communication with a compression portion defining said compression chamber.

3. The apparatus of claim 2, wherein said drive portion is in the form of an electric motor.

4. The apparatus of claim 2, wherein said means for oscillating the baffles comprises a cam mechanism adapted to translate the rotatable motion of the drivable shaft into the back and forth oscillation movement of the baffles.

5. An apparatus for pumping or compressing a fluid, the apparatus comprising:

a main housing block adapted to provide a drive portion supporting a rotatably drivable shaft in operable communication with a compression portion of said main housing block; the compression portion defining a compressor chamber in its interior; the compressor chamber including a compressor adapted to compress admitted fluid;

wherein the compressor comprises a plurality of radial compartments wherein intermittent baffles define a boundary for each radial compartment, enclosed therein each said radial compartment is a triangular segment, wherein the triangular segments are adapted to move relative to the baffles that define the radial compartments; said radial compartments comprising two inlet apertures to admit fluid and two outlet holes to discharge pressurized fluid;

a fluid control arrangement adapted to control admitted and discharged fluid to and from the radial compartments making up the compressor chamber, the fluid control arrangement including a rotatable circular plate with a series of symmetrically placed holes there along such that the rotation of the rotatable circular plate allows the opening or partial opening of one inlet aperture to one of the radial compartments of the compressor portion and the closing or partial closing of the other inlet aperture of the one compartment; the fluid flow control arrangement further comprises one way control valves on each of the outlet apertures of the radial compartments of the compressor;

a cam mechanism adapted to translate the rotatable motion of the rotably drivable shaft into a back and forth oscillation movement to create relative movement between the baffles against the triangular segments to create a bellowing effect adapted to admit fluid into the respective radial compartments and adapted to simultaneously discharge thereout through one of the outlet apertures.

6. The apparatus of claim 5, wherein when one edge of the triangular segments moves up against the intermittent baffles fluid is compressed while on the other side of the triangular segments fluid is admitted therein by virtue of the symmetrically placed holes of the rotatable circular plate having aligned over corresponding inlet holes and thereby allowing the admission of fluid therein to the radial compartment.

7. The apparatus of claim 6, wherein on the opposed side of the triangular section which has had its inlet hole covered or partly covered by this oscillating back and forth rotable circular plate, no fluid or reduced amounts of fluid are being admitted.

8. The apparatus of claim 7, wherein when the triangular segment is rotated towards one of the intermitted baffles the fluid is being compressed and discharged through one of the one way control valves.

9. The apparatus of claim 5, wherein each triangular segment comprises an orifice or elongated recess at least partially extending into the depth of said triangular segment, wherein each of the orifices or elongated recesses are located on an opposing side of each of the triangular segments so that inside the radial compartment such that the recesses on opposing sides of each of the triangular segments exclusively engage with just one single inlet aperture.

10. The apparatus of claim 9, wherein the orifices or elongated recesses of the triangular segments extend to the depth of the triangular segment on opposing edges of the triangular segment and are substantially conical or cone type in configuration with part of the edge, length or shoulder of the conical configuration opened up such that it is adapted to provide a fluid passage flow moving from a space of varying bounded dimension.

11. The apparatus of claim 5, wherein the inlet apertures are a series of holes placed on a covering plate that defines the radial diameter of the radial compartments.

12. The apparatus of claim 5, wherein the intermittent baffles are rotatably supported and each of the triangular segments remain fixed in place within said compressor chamber.

13. The apparatus of claim 12, wherein the intermittent baffles that provide the radial compartments include therein triangular segments of smaller dimension.

14. The apparatus of claim 12, wherein said intermittent baffles are supported on a rotatable shaft wherein the shaft by virtue of its structural arrangement with the cam mechanism will oscillate or swing back and forth over a defined degree of angle.

15. The apparatus of claim 14, wherein the degree of rotation of the back and forth oscillating movement between the intermittent baffles and the triangular segments is twenty degrees.

16. An apparatus for pumping or compressing a fluid including: a compressor chamber including a central shaft and a plurality of radial compartments, wherein a boundary of each compartment is partially defined by adjacent baffles of a plurality of intermittent, radially disposed baffles, whereby disposed in each said radial compartment is a fixed solid segment having a substantially triangular structure extending between the central shaft and an inner edge of the chamber with respect to which the baffles are adapted to move to compress admitted fluid, said chamber having a plurality of inlet aperture pairs disposed at an inlet end of the chamber and corresponding with each radial compartment, of which each inlet aperture is positioned relative to a corresponding side edge of a solid segment in the corresponding compartment to admit fluid, and a plurality of outlet hole pairs disposed at an outlet end of the chamber opposite the inlet end, each outlet hole pair including a first and a second hole coaxially aligned with the first and second inlet apertures, to discharge pressurised fluid;

a fluid control arrangement including a rotatable circular plate at the inlet end of the chamber which substantially covers the inlet aperture pairs, the plate being rotatable with the central shaft and baffles and including a series of symmetrically placed holes positioned such that the rotation of the plate allows the opening or partial opening of said first inlet apertures by aligning with the holes to admit fluid into the radial compartments on an admission side of each solid segment and the simultaneous closing or partial closing of the second inlet apertures to compress fluid in the radial compartments on the compression side of each solid segment;

said fluid control arrangement further including one way control valves on each of the outlet holes configured to open and thereby allow discharge of fluid after sufficient pressure is established in the compression side of each solid segment inside each compartment; and a means of rotating the central shaft and thereby moving the baffles and the plate in a back and forth rotational oscillation to create relative movement between the baffles against the solid segments such that during rotation in one direction, fluid is admitted into each radial compartment in the admission side of each solid segment and fluid is simultaneously discharged thereout from the compression side of each solid segment.

17. An apparatus as characterised in claim 16 further including a drive portion supporting a rotatably driveable shaft in operable communication with the central shaft.

18. An apparatus as characterised in claim 17 wherein said drive portion includes an electric motor for rotating said driveable shaft.

19. An apparatus as characterised in claim 17 wherein said means of oscillating the baffles and plate is in the form of a cam mechanism adapted to translate the rotatable motion of the drivable shaft into a back and forth oscillation movement of the central shaft.

20. An apparatus as characterised in claim 16 wherein when one of said adjacent baffles moves up against one edge of a corresponding solid segment, the baffle is compressing fluid in the compression side, and the admission side of the solid segment is admitting fluid therein by virtue of the adjacent baffle moving away from the opposed edge of the solid segment and the intermittent holes of the plate having aligned over the corresponding inlet aperture and thereby allowing the admission of fluid therein.

21. An apparatus as characterised in claim 20 wherein each solid segment includes elongated recess at least partially extending into the depth of said segment at an inlet end thereof, wherein each of the recesses is located on an opposing edge of the solid segment to thereby form a recess pair associated with each solid segment which are substantially aligned with corresponding inlet aperture pairs.

22. An apparatus as characterised in claim 20 wherein each solid segment includes an elongated recess at least partially extending into the depth of said segment at an outlet end thereof, wherein each of the recesses is located on an opposing edge of the solid segment to thereby form a recess pair associated with each solid segment which are substantially aligned with corresponding outlet hole pairs.

23. An apparatus as characterised in claim 21 wherein the recesses of the solid segments are substantially conical in configuration.

24. An apparatus as characterised in claim 22 wherein the recesses of the solid segments are substantially conical in configuration.

25. An apparatus as characterised in claim 16 wherein the inlet apertures are a series of apertures extending through a covering plate associated with the chamber inlet.

26. An apparatus as characterised in claim 25 wherein the outlet holes are a series of holes extending through a covering plate associated with the chamber exit, the exit covering plate being of similar dimension to that of the inlet covering plate.

27. An apparatus as characterised in claim 19 wherein said baffles are rotatably supported on said central shaft wherein the shaft by virtue of its structural arrangement with the cam mechanism will oscillate or swing back and forth over a defined degree of angle.

28. An apparatus as characterised in claim 27 wherein the degree of rotation of the back and forth oscillating movement between the baffles and the solid segments is twenty degrees.

* * * * *